United States Patent [19]

Beck

[11] Patent Number: 5,011,511

[45] Date of Patent: Apr. 30, 1991

[54] GRINDING TOOL

[76] Inventor: Alexander Beck, Rebbergstrasse 34, CH-8113 Boppelsen, Switzerland

[21] Appl. No.: 385,735

[22] Filed: Jul. 26, 1989

[30] Foreign Application Priority Data

Jul. 27, 1988 [CH] Switzerland ..... 2854/88

[51] Int. Cl.[5] ..... B24B 1/00

[52] U.S. Cl. ..... 51/295; 51/293; 51/309

[58] Field of Search ..... 51/293, 295, 309

[56] References Cited

U.S. PATENT DOCUMENTS

| | | | |
|---|---|---|---|
| 4,138,229 | 2/1979 | Tadokoro et al. | 51/295 |
| 4,298,356 | 11/1981 | Teschner et al. | 51/295 |
| 4,317,660 | 3/1982 | Kramis et al. | 51/295 |
| 4,666,466 | 5/1987 | Wilson | 51/295 |
| 4,689,242 | 8/1987 | Pike | 51/295 |
| 4,773,920 | 9/1988 | Chasman | 51/293 |
| 4,776,862 | 10/1988 | Wiand | 51/293 |
| 4,821,461 | 4/1989 | Holmstrand | 51/309 |
| 4,883,500 | 11/1989 | Deakins et al. | 51/309 |

*Primary Examiner*—William R. Dixon, Jr.
*Assistant Examiner*—Willie J. Thompson
*Attorney, Agent, or Firm*—Peter K. Kontler

[57] ABSTRACT

A material removing tool wherein a wheel-shaped, rod-like, tubular or otherwise configurated carrier supports pulverulent and/or granular particles of abrasive material which are joined to each other and/or to the carrier by active solder, such as an alloy or an eutectic of copper, silver, titanium and/or zirconium. The particles can be individually joined to the carrier or they can form a compact wherein the particles are held together by active solder. The compact can be joined to the carrier by active solder or by a standard solder, such as common solder or eutectic solder. That surface of the carrier which is joined with particles of abrasive material can be provided with recesses for portions of abrasive particles which are joined to the carrier by active solder.

20 Claims, 1 Drawing Sheet

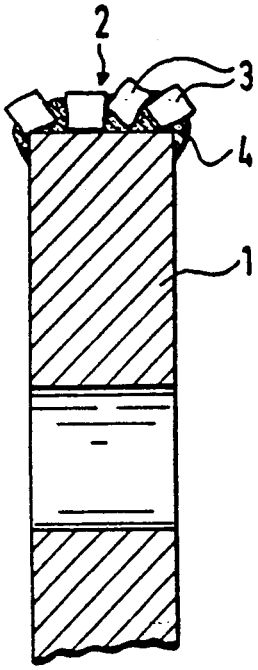
Fig. 1
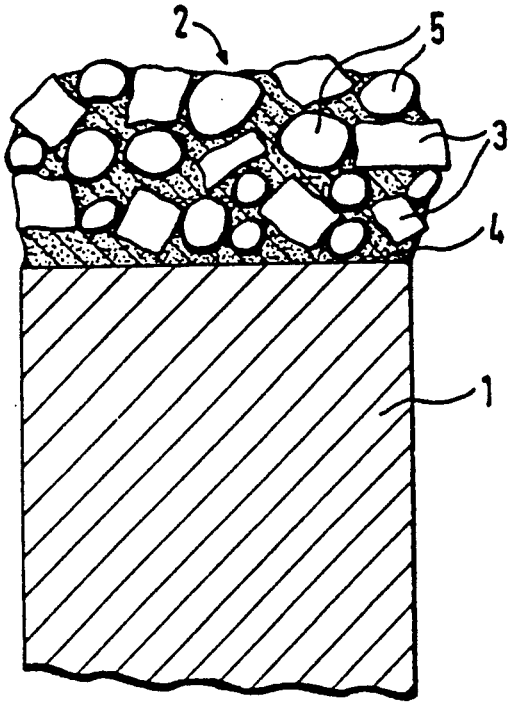
Fig. 2
Fig. 3
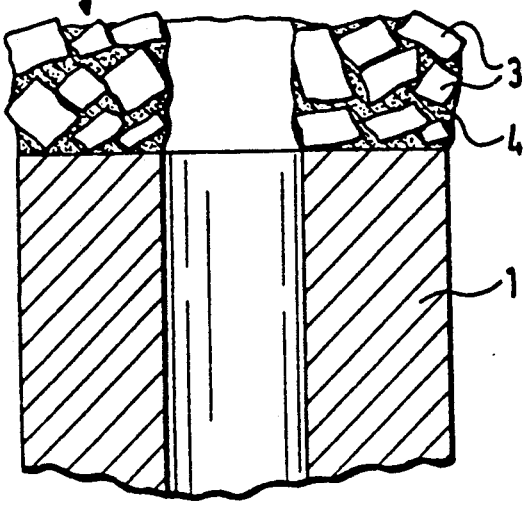
Fig. 4
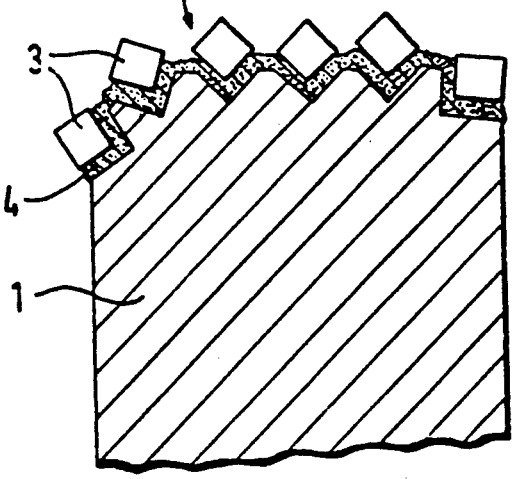

GRINDING TOOLcBACKGROUND OF THE INVENTION

The invention relates to material removing tools in general, and more particularly to improvements in material removing tools of the type wherein a carrier is provided with one or more layers of particles which consist of or contain an abrasive material and wherein the particles of abrasive and/or other material are bonded to the carrier.

Material removing tools (e.g., in the form of grinding wheels) are used in numerous branches of the industry, for example, to remove material from objects which are made of or contain glass, ceramic substances, concrete, rock, hard metals and many others. Such tools can be mounted for rotary or reciprocatory movement, and their size and/or the shape of their material removing portions can vary within a wide range. The particles of abrasive material which is used in such tools can be diamonds or they can be made of corundum, boron nitride, silicon carbide, cemented carbide and/or many other well known hard or extremely hard materials. The particles of abrasive material are normally embedded in a layer of metallic binder material which is applied to one or more selected portions of a carrier (e.g., to the peripheral surface of a wheel-shaped carrier). The layer is or can be applied electrolytically and form-lockingly (i.e., mechanically) engages and retains the embedded particles of abrasive material. It is also known to combine particles of abrasive material with binders of metal, glass, plastic, rubber or other suitable binder material in order to form therewith prefabricated shaped products which are secured to the carrier. Again, the particles of abrasive material in such prefabricated products are in mere mechanical form-locking engagement with the binder or binders.

A mere form-locking connection between the particles of abrasive material and the binder and/or carrier (this is the presently known way of holding abrasive material on the carrier of a grinding tool or the like) is not entirely satisfactory. A serious drawback of such connection is that the binder material must be continuously removed as the wear upon the tool progresses because this is the only way to expose additional portions of particles of abrasive material. Removal of binder material takes place automatically when the tool is in use, i.e., as a result of necessarily occurring wear upon the binder material in the course of a grinding or analogous material removing operation. Alternatively, or in addition to such necessarily occurring wear upon the binder material, the latter can be intentionally removed by a dressing tool in order to expose a certain amount of abrasive material. In either event, when the tool is in actual use and the particles of abrasive material encounter a pronounced resistance to penetration into a hard object, the weakened bond between the particles and the binder entails premature separation of particles of abrasive material from the carrier. As a rule, the particles are detached from the carrier before they are used up by more than 50 percent. This is particularly undesirable when the particles consist of an expensive abrasive material such as fragments of industrial diamonds, cubic boron nitride and certain others. In other words, the useful life of a conventional tool wherein the particles of abrasive material are form-lockingly connected with the binder and/or with the carrier is too short and a high percentage of abrasive material is wasted as a result of premature expulsion from the binder.

OBJECTS OF THE INVENTION

An object of the invention is to provide a material removing tool wherein the particles of abrasive material are less likely to become separated from their carrier and/or binder than in heretofore known tools.

Another object of the invention is to provide a highly reliable bond between particles of abrasive material and/or between such particles and the carrier.

A further object of the invention is to provide a grinding tool or an analogous material removing tool, the useful life of which is much longer than that of heretofore known tools.

An additional object of the invention is to provide a novel and improved method of retaining particles of abrasive material on their carrier.

Still another object of the invention is to prevent premature separation of particles of abrasive material from their binder and/or carrier.

A further object of the invention is to provide a novel and improved grinding wheel and a novel and improved drilling tool.

An additional object of the invention is to provide a material removing tool wherein the particles of abrasive material are reliably held on the carrier even after extensive wear in the range well above 50 percent.

SUMMARY OF THE INVENTION

One feature of the invention resides in the provision of a material removing tool, such as a grinding tool which is designed to remove material from hard or very hard objects (e.g., to drill holes in rock). The improved tool comprises a first component including a carrier (such as a wheel, a rod or a tube), a second component which includes particles of abrasive material adjacent a portion at least of the carrier, and a binder of active solder which is joined to at least one of the components, i.e., to the particles of abrasive material and/or to the carrier. If the active solder is joined to the carrier, the material of the carrier must be compatible with active solder. Such material can be a metal, for example, steel. The binder can be joined to each of the two components, i.e., it can bond the particles of abrasive material to each other and to the carrier.

The second component can constitute a cake (hereinafter called compact) of pulverulent and/or other abrasive material, and at least a portion of the binder can serve to bond the particles of the compact to each other. Another portion of the binder can serve to bond the compact to the carrier. Alternatively, a second binder of standard solder (e.g., eutectic solder, common solder or half-and-half solder) can be used to bond the compact to the carrier.

The second component can contain or constitute a mixture of particles having different chemical compositions. Moreover, the particles of abrasive material can have different sizes and/or different shapes. Furthermore, the second component can contain a mixture of pulverulent and granular particles which are joined by the binder of active solder. The pulverulent particles of such mixture can consist of abrasive material having a pronounced or highly pronounced hardness, and the granular particles of the mixture can consist of metal.

It is also possible to employ a second component which consists of granules having a pronounced or very pronounced hardness. The binder is used to join such granules to each other.

The surface of the carrier can be provided with regularly or irregularly distributed, identical or differently dimensioned and/or shaped recesses for particles of abrasive material. The particles are bonded to the carrier by active solder.

The binder of active solder can be selected from the group consisting of copper-silver-titanium alloys, copper-titanium alloys, copper-zirconium alloys, copper-titanium eutectics and copper-zirconium eutectics.

The second component can contain or consist of industrial diamonds and/or boron nitride or other abrasive materials.

The tool can be used as a grinding wheel, as a tubular core drill, as a straight rod-shaped drill, as the tool of a rock drill or for a host of other purposes.

Another feature of the invention resides in the provision of a method of making a material removing tool. The method comprises the steps of forming a layer of particles of abrasive material, active solder bonding the particles to each other, and securing the layer of solder bonded particles to a carrier. The securing step can include active solder bonding the layer to the carrier, either simultaneously with or following bonding of particles to each other. At least one of the bonding and securing steps includes soldering with active solder.

The novel features which are considered as characteristic of the invention are set forth in particular in the appended claims. The improved material removing tool itself, however, both as to its construction and the method of making the same, together with additional features and advantages thereof, will be best understood upon perusal of the following detailed description of certain presently preferred specific embodiments with reference to the accompanying drawing.

It is to be understood that the binder in the context of this invention is a metal solder or braze having a lower melting point than any of the body materials of the carriers, granules or particles constituting the tool. It is also to be understood that the mechanism of bonding is by way of the formation of a mutual diffusion zone in the contact areas of the solder with the parts and particles to be bonded, whereby such a diffusion may be initiated by a chemical reaction of at least one of the constituting metals of the solder with the material to be bonded during the molten stage of the solder in the soldering process. Solders capable of such chemical surface reactions are generally known under the term active solder.

BRIEF DESCRIPTION OF THE DRAWING

FIG. 1 is a fragmentary axial sectional view of a material removing tool which has a wheel-shaped carrier for abrasive material;

FIG. 2 is a fragmentary axial sectional view of a second tool wherein the carrier is a rod;

FIG. 3 is a fragmentary axial sectional view of a third tool wherein the carrier is a tube; and FIG. 4 is a fragmentary axial sectional view of a tool which can be utilized in a rock drill.

DESCRIPTION OF PREFERRED EMBODIMENTS

FIG. 1 shows a portion of a material removing tool having a wheel-shaped carrier 1 which is made of steel and has a cylindrical peripheral surface surrounded by a layer 2 of differently dimensioned and/or oriented particles 3 of abrasive material. The particles 3 are made of a hard or extremely hard material, such as fragments of industrial diamonds, boron nitride and the like. The binder 4 which bonds the particles 3 to each other and adheres to the material of the carrier 1 is an active solder. This material, is selected in such a way that it is bonded to the particles 3 as well as to the carrier 1. In other words, the connection between the binder 4 on the one hand and the particles 3 and carrier 1 on the other hand is not a mere mechanical form-locking connection which becomes weaker as the wear upon the binder 4 progresses, but rather an adhesive election bonding connection which renders it possible to use the tool to the very end, i.e., until all of the particles 3 are used up. Thus, the bond between the particles 3 and the binder 4 and/or between the binder 4 and the carrier 1 does not become weaker in response to progressing wear upon the binder and/or particles. This, in turn, ensures that the useful life of the improved tool is incomparably longer than that of a conventional tool wherein the particles of abrasive material are mechanically connected to the binder. It has been found that the useful life of the improved tool is more than twice that of a standard tool.

The exact composition of active solder which can be used to form the binder 4 constitutes no part of the present invention. Such solders are available on the market. An active solder is an alloy of two or more metals at least one of which exhibits a pronounced chemical affinity to oxygen, carbon or nitrogen which are common constituents in abrasive hard materials forming strong bonded crystal structures. However, the high affinity of the active metal atoms within the solder to the nonmetallic elements in the hard materials causes a chemical reduction of atoms in particles 3 whereby atoms of the active metals in the binder 4 are oxydized to different oxydes, carbides or mitrides in a diffusion layer or zone adjacent particles 3. This reduction - oxydation process takes place in the melted stage of the solder during the soldering process, thus forming a very strong and tensile bond between the binder 4 and the particles 3 and/or the carrier 1, allowing the transmission of high stresses and shear forces through the binder 4 to the carrier 1 without separation of particles 3 from the binder 4 even if the area of contact between a partially consumed or nearly fully consumed particle of abrasive material and the binder is small or very small.

If the particles 3 are diamonds, the diffusion layers between such particles and the binder 4 consist of or contain carbides. By way of example, one can use an active solder which is an alloy containing approximately 72 percent by weight silver, approximately 20 percent by weight of copper and 8 percent by weight of titanium. Other suitable active solders are alloys or eutectics of copper and titanium or copper and zirconium. Active solders which can be used in the improved tool are available on the market under No. 8972 at the firm Doduco KG, D-7530 Pforzeim, Federal Republic of Germany.

The chemical reaction which takes place as a result of bonding of the particles 3 to the carrier 1 with a binder 4 of active solder can be detected with the naked eye if, prior to soldering, the particles 3 consist of a transparent or light-transmitting material. Thus, the soldering imparts a greyish tint to or blackens the particles and the surfaces of the particles are roughened as a result of chemical reaction with active solder. Moreover, the observable total optical reflection of light within the particles 3 in tools of prior art is negligible or nil when the soldering operation is completed.

FIG. 2 shows a portion of a second tool wherein the first component comprises a carrier 1 which is a solid cylindrical or a similarly shaped steel rod one end face of which carries a layer 2 of particles of abrasive material. The particles include first particles 3 which exhibit sharp edges and can constitute fragments of industrial diamonds or fragments of boron nitride, and rounded particles 5 of a metallic material. The binder 4 is an active solder. This solder has chemically reacted with the particles 3, 5 as well as with the carrier 1. It will be noted that the layer 2 has several individual strata of particles having different sizes and different shapes as well as particles consisting of different materials, i.e., materials having different chemical and/or other properties.

Referring to FIG. 3, there is shown a portion of a tubular material removing tool having a tubular (e.g., cylindrical) carrier 1 of steel or another material which can chemically react with active solder (binder 4). The layer 2 consists of particles 3 having sharp edges and having different sizes and shapes. The binder 4 holds the layer 2 at one end face of the carrier 1.

In order to ensure that the layer 2 will exhibit a hole which registers with the axial hole of the carrier 1 in assembled condition of the tool which is shown in FIG. 3, the particles 3 can be caused to form a ring-shaped cake or compact wherein the particles are bonded to each other by active solder, and the thus obtained ring-shaped compact is then joined to the end face of the carrier 1 by active solder or by a standard solder, e.g., a so-called half-and-half solder, a so-called common solder, a so-called eutectic solder or a so-called hard solder. In other words, active solder can be used to establish a bond with the particles 3 of the layer 2, and the same solder or a standard solder can be used to bond the finished compact (layer 2 and binder 4) to the end face of the carrier 1. The particles 3 can be so small that they can be said to constitute dust particles.

The layer 2 of FIG. 3 can contain fragments of industrial diamonds, boron nitride, metallic particles or a mixture of particles which consist of two or more different materials. For example, the layer 2 of FIG. 3 can contain metallic particles of the type shown at 5 in the layer 2 of FIG. 2.

Relatively thick layers 2 of the type shown in FIGS. 2 and 3 are preferably/preformed as compacts in the aforedescribed manner to be thereupon bonded to selected surfaces of the respective carriers. Such compacts can be said to consist of a metal with particles of hard abrasive material (including other metals) embedded therein. The particles are held against separation by active solder. The compacts can contain compacted mixtures of filling metal dust, hard abrasive material and active solder. The mixtures are subjected to a requisite heat treatment above the melting point of active solder. The thus obtained compacts (which are permeated with active solder) exhibit a very pronounced mechanical stability.

It is also within the purview of the invention to make compacts exclusively from dust of abrasive material and active solder. This contributes to an even longer useful life of the compact because the latter does not contain any non-abrasive particles. In fact, the entire tool (including the carrier) can constitute a compact of minute particles of abrasive material and active solder. Still further, it is possible to assemble the compact and the carrier prior to heat treatment. This simplifies the making of the tool because active solder is bonded to the particles of the compact simultaneously with bonding to the carrier. In other words, compression of minute particles of abrasive material and particles of active solder results in the making of a raw compact which is thereupon consolidated by heating the compact to a temperature above the melting point of active solder while the compact is adjacent a selected surface of the carrier to thus ensure the establishment of a bond between the solder and the particles of the compact as well as between the solder and the carrier. As mentioned above, it is also possible to establish very strong bonds between the particles of abrasive material and active solder (to complete the making of the compact) and to thereupon use active solder or a standard solder to bond the finished compact to the selected surface or surfaces of the carrier.

FIG. 4 shows a portion of a material removing tool wherein the carrier 1 is or can be made of steel and one of its surfaces is provided with regularly or irregularly distributed, configurated and/or shaped recesses for portions of relatively large particles 3 forming a layer 2 of abrasive material. The binder 4 is active solder. Such binder merely bonds the particles 3 to the carrier 1 because the particles of the tool which is shown in FIG. 4 are too far apart to be bonded to each other. For example, the tool of FIG. 4 can be used in a rock drill. An advantage of the tool of FIG. 4 is that the particles 3 of abrasive material are even less likely to become prematurely separated from the binder 4 and/or from the carrier 1 because they are form-lockingly connected as well as chemically bonded to the binder. It has been found that the tool of FIG. 4 can stand very pronounced shearing stresses when it is used in a drill to make holes in hard rock or like materials.

An important advantage of the improved tool and of the novel method of making the tool is that the useful life of the tool is much longer than that of a standard tool, even if the material of the carrier and the material or materials of the abrasive material are the same as in a conventional tool and even though the active solder which is used to bond the particles of abrasive material to each other and/or to the carrier is or can be a commercially available active solder. As mentioned above, longer useful life of the improved tool is attributable to the fact that the particles of abrasive material wear away completely or nearly completely because they are unlikely to become separated from the binder 4 and/or from the carrier 1 as a result of wear upon such particles and/or upon the binder.

The tool of FIG. 4 exhibits the advantage that the particles 3 which form its layer 2 are even less likely to become prematurely separated from the binder 4 and from the carrier 1 because they are form-lockingly and chemically connected to the binder. The size of pulverulent abrasive material can be in the range of 0,5 $\mu$m to 100 $\mu$m.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A material removing tool, particularly for removing material from hard objects, comprising a rigid carrier; particles of abrasive material adjacent a portion at least of said carrier, said portion of said carrier consisting of solderable material; and a binder of active solder rigidly joining said particles to said carrier.

2. The tool of claim 1, wherein said particles constitute a compact of pulverulent abrasive material and at least a portion of said binder is joined to said pulverulent abrasive material.

3. The tool of claim 2, wherein another portion of said binder joins said compact to said carrier.

4. The tool of claim 2, further comprising a second binder of standard solder between said compact and said carrier.

5. The tool of claim 1, wherein said particles are a mixture of particles having different chemical compositions.

6. The tool of claim 1, wherein said particles are a mixture of particles having different sizes.

7. The tool of claim 1, wherein said particles are a mixture of particles having different shapes.

8. The tool of claim 1, wherein said particles are a mixture of pulverulent and granular particles which are joined by said binder.

9. The tool of claim 8, wherein said pulverulent particles consist of abrasive material having a pronounced hardness and said granular particles consist of a metal.

10. The tool of claim 1, wherein said particles include granules having a pronounced hardness and said binder joins such granules to each other.

11. The tool of claim 1, wherein said carrier has a surface provided with recesses and said particles extend into said recesses.

12. The tool of claim 1, wherein said binder is selected from the group consisting of copper-silver-titanium alloys, copper-titanium alloys, copper-zirconium alloys, copper-titanium eutectics and copper-zirconium eutectics.

13. The tool of claim 1, wherein said carrier consists of or contains steel and said particles consist of or contain industrial diamonds and or boron nitride.

14. The tool of claim 1, wherein said carrier includes a wheel.

15. The tool of claim 1, wherein said carrier includes a tube.

16. The tool of claim 1, wherein said carrier includes a bar or rod or wire or strip.

17. The tool of claim 1, wherein said carrier forms part of a rock drill.

18. A method of making a material removing tool, comprising the steps of forming a layer of particles of abrasive material; bonding the particles to each other by active solder; and securing the layer of active solder bonded particles to a rigid solderable carrier.

19. The method of claim 17, wherein said securing step include active solder bonding the layer to the carrier.

20. The method of claim 17, wherein at least one of said bonding and securing steps includes soldering with active solder.

* * * * *